United States Patent [19]

Kroll et al.

[11] 4,310,944

[45] Jan. 19, 1982

[54] SURFACE MAINTENANCE MACHINE HAVING AIR RECIRCULATION

[75] Inventors: Harley E. Kroll, Chaska; Donald L. Thomsen, Minneapolis, both of Minn.

[73] Assignee: Tennant Company, Minneapolis, Minn.

[21] Appl. No.: 137,572

[22] Filed: Apr. 7, 1980

Related U.S. Application Data

[62] Division of Ser. No. 873,226, Jan. 30, 1978, Pat. No. 4,206,530.

[51] Int. Cl.[3] ..... A47L 11/202

[52] U.S. Cl. ..... 15/346; 15/340; 15/349

[58] Field of Search ..... 15/340, 345, 346, 347, 15/349

[56] References Cited

U.S. PATENT DOCUMENTS

| | | | |
|---|---|---|---|
| 857,415 | 6/1907 | Pum | 15/349 X |
| 1,207,816 | 12/1916 | Thompson | 15/349 X |
| 1,459,968 | 6/1923 | Bailly | 15/347 X |
| 3,755,851 | 9/1973 | Williams | 15/346 |
| 4,006,511 | 2/1977 | Larsen | 15/346 X |

*Primary Examiner*—Chris K. Moore
*Attorney, Agent, or Firm*—Norman P. Friederichs

[57] ABSTRACT

A powered sweeping machine is disclosed, particularly suitable for efficiently removing light and heavy weight litter from surfaces such as parking lots, warehouse floors and the like. The machine includes a main frame carrying a hopper and a powered brush. The brush operates through an opening in the lower side of a brush housing. The hopper is separated into a debris receiving compartment and a filter compartment. An air fan and an associated duct recirculates air from the far end of the debris compartment to a zone adjacent the brush. This nonfiltered air is discharged into the brush housing and again moved through the debris compartment to aid in moving debris to the far end of the debris compartment. A fan is provided for withdrawing a portion of the air from the filter compartment and discharging the air to the ambient atmosphere. The withdrawal of a portion of the air results in more air flowing into the brush housing than is recirculated through the brush housing and thus provides dust control at the base of the brush housing.

10 Claims, 10 Drawing Figures

SURFACE MAINTENANCE MACHINE HAVING AIR RECIRCULATION

This is a division of application Ser. No. 873,226, filed Jan. 30, 1978, now U.S. Pat. No. 4,206,530.

BACKGROUND OF THE INVENTION

The present invention relates to a sweeping machine that has a hopper for collecting debris removed from a surface and more particularly to a sweeping machine that utilizes recirculated, relatively low pressure air to improve the loading efficiency of the debris hopper especially with light weight litter.

A wide variety of cleaning machines have been known in the past. U.S. Pat. No. 3,304,572 discloses a surface cleaning machine having a hopper divided into a debris collection compartment and a filter compartment. A suction blower draws air from the filter compartment and discharges the air to the ambient atmosphere. A brush is used to sweep debris into the hopper. In using machines of this type for sweeping light debris it has been found that the hopper is often not filled to the degree desired. Instead the portion adjacent the brush tends to clog up. U.S. Pat. No. 1,211,902 discloses a railway track cleander having a duct and double blower arrangement for dust control and recirculation of air. The recirculation of air, with a compression pump through a blast nozzle, is to provide an air blast for loosening the dirt from the roadway. The high pressure blast air requires significant power. This structure does not prevent clogging. Other patents describe similar systems, for example, see U.S. Pat. Nos. 4,006,511; 3,755,851; 2,932,845; 3,872,540. British Pat. No. 808,026 shows a sweeping machine in which air is drawn through a combination filter and debris hopper. An air stream may be directed to a zone adjacent a housed brush. To help prevent debris from escaping to the sides, the debris may be blown toward the center of the brush. This machine also is not particularly suitable for sweeping up light debris and uniformly filling the hopper to the desired degree. In other prior art machines there have been problems encountered due to high air flow requirements with encumbrances on power needs, dust filter concerns and high noise levels. The present sweeping machine overcomes such problems.

SUMMARY OF THE INVENTION

The present invention provides a surface cleaning machine or sweeper that has a power driven rotary brush disposed in a downwardly opening housing. The present sweeper has a combination filter-debris collection hopper for receiving debris directly from the brush housing. The sweeper has a fan for withdrawing filtered air from the hopper and discharging it to the ambient atmosphere. The sweeper also has a recirculating air loop for withdrawing nonfiltered air from the hopper and feeding the air, under low pressure, into the housing to aid the brush in moving debris into the hopper. The sweeper may have one separate fan for each of the two air systems or it may use one fan with splitting of the air flow into two separate paths. Debris may be swept up by the under part of the brush and moved toward and into the hopper. A deflector may be mounted in the brush housing to abut or lie closely adjacent the top of the brush to disperse or guide the air into the brush chamber. A deflector for control of the air flow and debris movement may be mounted in a generally tangential position, closely adjacent the rear of the brush. The deflector may be inclined downwardly in a direction toward the housing discharge outlet.

The present invention provides a new and novel surface maintenance or sweeping machine with a brush for sweeping a surface. The sweeper utilizes recirculated air to enhance loading of the hopper, particularly when light debris is being swept up. The present invention maintains dust control with a minimum amount of air movment through a filter, thus minimizing the filter size and power requirements and minimizing the pressure required for the recirculated air.

DETAILED DESCRIPTION

Figure 1:
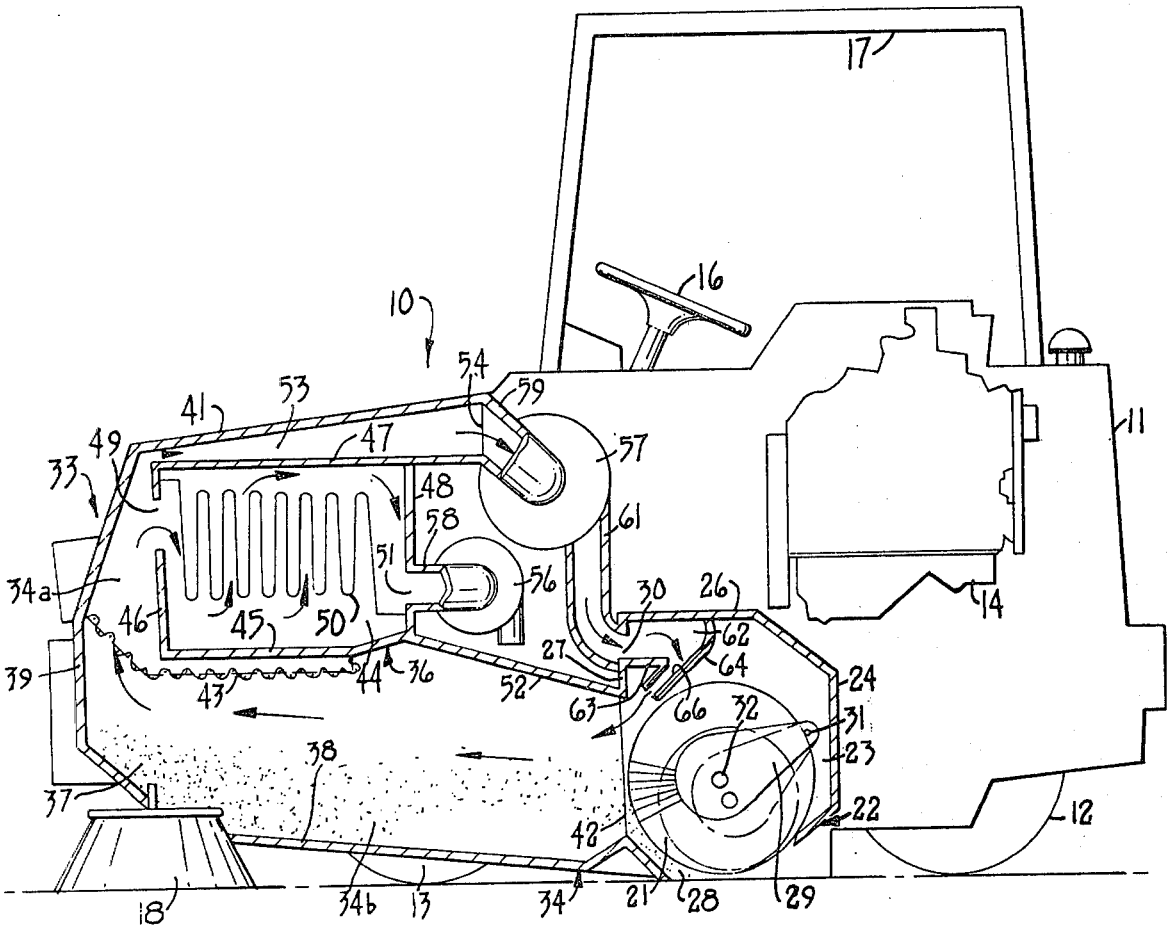
FIG. 1 is a side elevational view, partly in cross-section and partly in diagrammatic form, illustrating one embodiment of the present invention.

A self-powered sweeping machine 10 constructed according to the present invention is illustrated in FIG. 1. The sweeping machine 10 may include a main frame 11 which is supported by a rear wheel 12 and a pair of front wheels 13. The wheels 12 and 13 may be of a pneumatic type. The rear wheel 12 may be driven by suitable power source such as a gasoline engine 14. The rear wheel 12 may be suitably connected to a steering wheel 16 by steering linkage (not shown). The main frame 11 may be of metal stock and may include an overhead guard 17. Since the present invention is not directed specifically to the construction of the main frame, wheel structures or power train, the details of such construction is not set forth. Such construction may be of a conventional nature.

The present sweeping machine 10 includes a cylindrical brush 21 which is mounted in a brush housing 22. The brush housing 22 may be of sheet or plate metal and includes a pair of side walls such as 23, a rear wall 24, a top wall 26 and a front wall 27. The housing 22 may have an opening 28 facing downwardly through which the brush 21 may contact the surface being cleaned. The walls 23, 24, 26 and 27 may terminate shortly above the surface to be swept. The lower portions of walls 23, 24, 26 and 27 may be resilient flaps or lips thus facilitating movement over rough terrain or low objects which cannot be swept up.

The brush 21 may be supported at each end by a pivotable arm such as 29. Each arm 29 is supported at one end with respect to the brush housing side wall 23 such as by a pivot pin 31. The brush 21 is rotatably supported at the other end of arm 29 such as by a shaft 32. The brush 21 is rotationally driven by motor 14 such as through a drive train such as with a hydraulic motor (not shown). The pivot arm 29 permits brush 21 to remain in contact with the surface to be swept even though brush 21 becomes worn. Also arm 29 pivots in such a manner as to maintain a substantially constant relationship with the lower portion of housing rear wall 24.

The sweeping machine 10 has a hopper 33 which may be supported on the main frame 11. The hopper 33 includes a debris compartment 34 and a filter compartment 36. The debris compartment 34 has a pair of side walls such as 37, a lower wall 38, a front wall 39 and a top wall 41, said walls enclosing compartment 34 except for the hereinafter described openings. The walls 37, 38, 39 and 41 may be secured together such as by welding. The debris compartment 34 opens rearwardly into the brush housing 22 through the opening 42. A screen 43 divides the compartment 34 into an upper portion **34*a* and a lower portion 34*b***.

The filter compartment 36 has a pair of side walls 44, a bottom wall 45, a front wall 46, a top wall 47 and a rear wall 48. The walls 44, 45, 46, 47 and 48 may be secured together such as by welding. The front wall 46 has an opening 49 therethrough which communicates with debris compartment upper portion **34*a*. Thus, opening 49 serves as an inlet for filter compartment 36. The rear wall 48 has an opening 51 defined therein which serves as an outlet. The filter 50** may be of conventional construction such as described in U.S. Pat. No. 3,160,908 and 4,032,307. There may be an agitator (not shown) such as described in said patent to aid in dislodging the dust which collects on the filter. Alternatively the dust may be dislodged by a back draft of air such as shown in U.S. Pat. No. Re. 24,954.

A wall 52 extends from filter 36 to brush housing front wall 27, thus, completing the enclosure of the debris compartment 34. A passageway 53 is defined between filter compartment 36 and upper debris compartment portion **34*a*. The passageway 53 has an opening 54** to the rear.

The sweeper 10 has a pair of fans or blowers 56, 57. The fan 56 is connected by a duct 58 to filter compartment 36. The fan 56 may be suitably supported such as on the main frame 11. The fan 57 is connected by duct 59 to the passageway 53 of compartment 34. The blower 57 also is connected to the brush housing 22 by a duct 61. The duct 61 communicates with brush housing 22 through an opening 30 defined in brush housing front wall 27. A manifold 62 is provided in the upper portion of brush housing 22. The manifold 62 has a lower wall 63 and a rear arcuate wall 64. The sides of manifold 62 are closed by the side walls 23 of brush housing 22. The forward portion of manifold 62 is closed by front wall 27 of brush housing 22 and the top of manifold 62 is enclosed by the top wall 26 of brush housing 22. An opening 66 is provided between manifold 62 and brush housing 22 for purposes hereinafter described.

The sweeper 10 may have a pair of rotary brushes such as 18 adjacent the front end of sweeper 10 to move dirt and debris inwardly to assure pick up by brush 21.

OPERATION OF THE INVENTION

Although operation of the present sweeping machine 10 would be apparent from the preceding description, it will be further described hereinafter in order to assure a full understanding of such use and operation. The sweeping machine 10 is placed in operation by starting the power unit 14 and engaging the propelling mechanism in forward. The direction in which the sweeping machine 10 is driven is controlled by appropriate operation of the steering wheel 16. The engine 14 also drives the cylindrical brush 21 in a clockwise direction as viewed in FIG. 1. The rotational speed of brush 21 may be suitable to enable the brush to throw the heavier debris such as dirt, small stones and the like into the forward portion of the debris compartment 34. Lighweight debris such as paper normally cannot be thrown by the brush 21 with sufficient force to carry the lightweight debris to the forward part of compartment 34. In the present invention, however, the air current moving through compartment 34 does provide sufficient force to carry the paper and lightweight debris to the forward portion of compartment 34. In other words, fan 57 withdraws air from the foreward portion of compartment 34 through passageway 53 returning the air to the brush housing 22 through duct 61. Air leaving duct 61 is fed into the manifold 62 and distributed substantially across the brush 21. This recirculated air may feed directly into opening 42, as shown by the arrow in FIG. 1. Alternatively at least a portion of the air may follow the periphery of the brush and pass beneath the brush. Such portion of air assists in picking up debris. All of the recirculated air passes through compartment 34. This current of air supports or buoys up the lighweight debris and carries such debris forwardly. The material also is packed and diversified by the air stream flowing through the compartment 34. Part of the air which has moved through compartment 34 is drawn into the filter compartment 36 by fan 56. This air exits the system into the atmosphere. This means that a greater amount of air is moved through compartment 34 than is recirculated through fan 57. The make-up air is drawn in through the opening 28 in the lower side of brush housing 22. Since this air is drawn into opening 28, any dust created by the sweeping action of brush 21 is drawn into the system rather than remaining outside housing 22.

The screen or grating 43 serves to block the movement of lightweight debris to the inlet port 49 of the filter compartment 36 and fan 56. A relatively low velocity air stream exists at the screen due to the large area of the screen. The low velocity of the air stream permits gravity separation of the debris from the air stream. The recirculating air passes through the screeen 43 but is not filtered. This recirculated air is withdrawn from the compartment 43 without passing through the filter compartment. A large volume of air is continuously recirculated with only a small part of the air passing out through the filter. This permits use of a smaller capacity filter than is required if all the air were filtered. Also, the filter air being exhausted to the surrounding atmosphere results in the entire sweeping system (i.e. brush chamber 22, debris compartment 34 and filter compartment 36) being operated at a pressure less than atmospheric, thereby providing air inflow around the brush chamber opening 28 to control dust.

Once the compartment 34 is substantially filled, it may be emptied. Any of various methods may be used for emptying compartment 34. For example, the compartment 34 may separate from brush housing 22 and tip so as to dump debris out through opening 42. Alternatively, one side of compartment 34 may be hinged to open and permit access for removal of the debris.

ALTERNATE EMBODIMENTS

Figure 2:
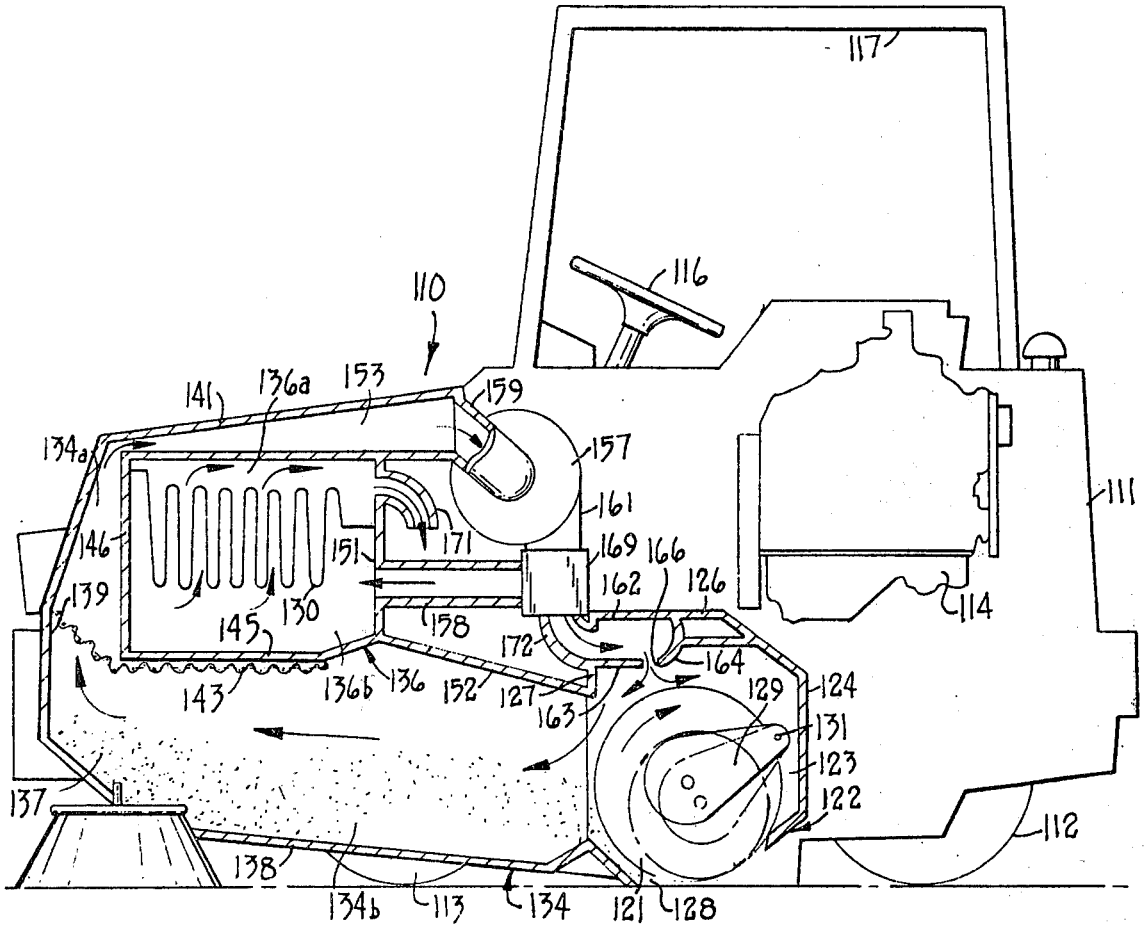
FIG. 2 is a similar view of another embodiment of the present invention.

An alternate embodiment 110 of the present invention is illustrated in FIG. 2. Sweeper 110 is similar in construction to sweeper 10, however, it is operated using a single fan or blower as hereinafter described. The sweeper 110 has a main frame 11 and wheels 112, 113. Sweeper 110 has a cylindrical brush 121 which operates in a clockwise rotation as shown in FIG. 2. The brush 121 may be supported on a pair of arms 129 in a housing 122 substantially as described with regard to sweeper 10. Sweeper 110 has a debris compartment 134 and a filter compartment 136. The debris compartment 134 is separated into an upper portion **134*a* and a lower portion 134*b* by a screen 143. The filter compartment 136 is divided into an upper portion 136*a* containing filtered air and a lower portion 136*b* containing unfiltered air. As air moves from filter compartment 136*b* to filter compartment portion 136*a*, dirt or airborne particles are removed by the filter 130**.

Fan 157 withdraws air containing airborne particles from debris compartment 134 through passageway 153. A diverter 169 is provided in the duct 161. The diverter 169 splits the air stream into a first portion that is fed through duct 158 into filter compartment 136. This air passes through filter 130 and out duct 171 into the atmosphere. The diverter 169 feeds the second portion of air into duct 172 which leads to the manifold 162. The air fed into manifold 162 is of course recirculated through the brush housing 122 and the debris compartment 134 to assist in moving lightweight debris into the forward portion of compartment 134 in a manner substantially like that described with regard to sweeper 10. The arrows indicate the flow pattern of the two air streams through sweeper 110. The diverter 169 is shown schematically. It may be either of throttling plate construction or it may be of butterfly valve construction which are adjusted electronically and controlled by sensing devices such as in ducts 158 and 172 to provide a proportional air flow through each of such ducts. Such a system including sensing devices is particularly desirable from an operational standpoint in that as the filter 130 accumulates particles, a partial blocking of the filter takes place. A sensing device may ascertain the degree of blockage and increase the force of the air flow through duct 58 thus compensating for such blockage. The filters in the present sweepers may be a type that can be vibrated or blown back with air to knock off accumulated particles of debris thus reducing blockage.

Figure 3:
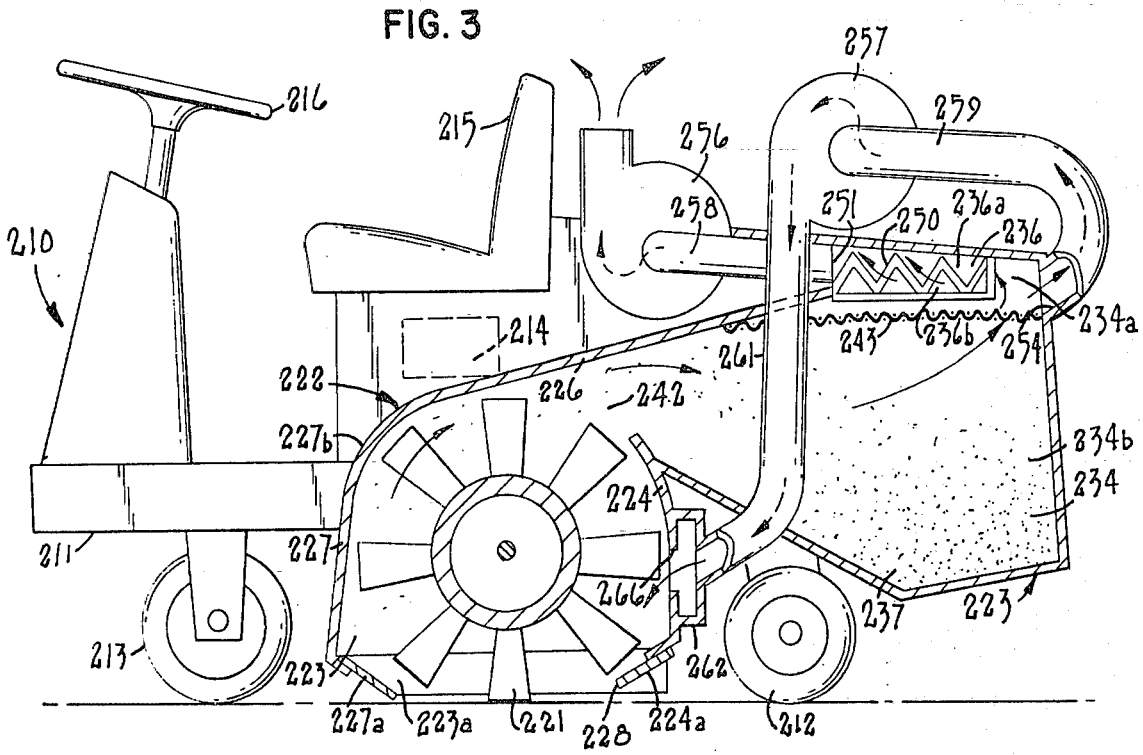
FIG. 3 is a side elevational view of a further embodiment of the present invention.
Figure 4:
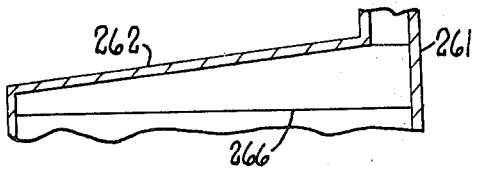
FIG. 4 is a fragmentary horizontal cross-sectional view of the cross duct for discharging air from the recirculating fan into the brush housing of the machine of FIG. 3.

Referring now to FIGS. 3 and 4, there is illustrated a self-powered sweeping machine 210. The machine 210 includes a main frame 211 that has a pair of rear driven wheels 212 and a front steerable wheel or wheels 213. The machine is driven, for example, by motor 214. The machine 210 has a steering wheel 216, and an operator's seat 215. Suitable controls such as ignition switch and transmission (not shown) are provided for operating the sweeping machine.

The machine 210 has a downwardly opening brush housing 222, which extends transversely across the machine 210 at the lower portion thereof and a cylindrical brush 221 mounted in the housing 222 for rotation in the direction of the arrow about a transverse axis. A suitable gear or pulley train (not shown) is provided between the motor 214 and the brush 221. The housing 222 includes side walls such as 223, a front wall 227, a rear wall 224, and a top wall 226. The housing 222 may include side skirts such as **223*a* depending from the side walls 223, a forward sweeping lip 227*a* attached to the lower edge of the front wall 227, and a rear deflector 224*a* attached to the rear wall 224. The side skirts 223*a*, sweeping lip 227*a* and rear deflector 224*a* may be of a relatively stiff, resilient material. The lower edges of skirts 223*a* and deflector 224*a* are closely adjacent the surface which is to be swept, thus limiting the passage of air and debris therebeneath. The lower edge of the resilient lip 227*a*** is spaced above the surface being cleaned a sufficient distance to permit passage of litter therebeneath.

An opening 242 is defined between the rear wall 224, the housing side walls 223 and the top wall 226. The opening 242 extends between debris compartment 234 and brush housing 222. The opening 242 preferably has a slightly greater transverse width than the transverse width of the brush 221.

The rear wall 224 may be arcuate and has only a slightly greater radius of curvature then the maximum radius of a new brush thus lying closely adjacent the brush 221. Additionally, the front wall 227 has an upper substantial arcuate portion **227*b* adjacent its juncture with the top wall 226. Arcuate portion 227*b* has a radius of curvature only slightly greater than the maximum radius of a new brush thus lying closely adjacent the brush 221. As a result, there is only a slight clearance space between portion 227*b* and 224 of the housing 222 and the brush 221 on longitudinally opposite sides of the downward opening of the housing 222**.

The hopper 233 includes a debris compartment 234 and a filter compartment 236. A screen or grating 243, which may be made of expanded metal, extends between the debris compartment side walls 237 and separates the debris compartment 234 into upper portion **234*a* and lower portion 234*b*. The screen 243 is spaced downwardly from the filter compartment 236 to provide an air flow space between screen 243 and filter compartment 236**.

A filter 250 extends across the filter compartment 236 to divide it into a lower nonfiltered air section **236*b* and an upper filtered air section 236*a***.

A fan 256 may be mounted on the sweeper frame 211. The fan 256 has an outlet that discharges air to the atmosphere. Fan 256 is connected by a duct 258 to opening 251 in filter compartment 236. When the fan 256 is operating, air is drawn in through the opening 228 in brush housing 222. Air from the brush chamber 222 passes through the debris compartment 234. A portion of the air passes through the filter compartment 236 and subsequently is discharged into the atmosphere. This provides for dust control by drawing air into housing 222.

A recirculating air fan 257 is also mounted on the sweeper frame 211. Air fan 257 has an inlet which is connected by a duct 259 to the debris compartment outlet port 254. The port 254 is at a location above the screen 243. The fan 257 feeds air through duct 261 to a manifold 262 mounted on the brush housing rear wall 224. The manifold 262 communicates with the interior of brush housing 222 through a transversely elongated opening or slot 266 in brush housing wall 224. Manifold 262 and slot 266 may be comparable transverse width with the housing 222. Slot 266 may be replaced with a plurality of slots or openings which serve the same purpose. The manifold 262 (as shown in FIG. 4) may be of a shape to provide a nearly uniform air flow across slot 266. In other words, manifold 262 may be contracted in size as it moves from duct 261. Preferably the opening 266 is positioned lower than at least a portion of the arcuate rear wall 224. The air discharging through opening 266 substantially all moves in the driven rotational direction of the brush. The discharging air preferably does not provide a blast directly toward the surface being cleaned as in non-brush, vacuumized recirculating air type surface cleaners of the type shown in U.S. Pat. No. 4,006,511.

During operation, the brush 221 is rotatably driven in a clockwise direction as shown in FIG. 3. As the machine 210 moves forwardly, debris passes beneath the lip 227*a* and is lifted from the surface being swept by the brush 221. The brush 221 is rotated at a rapid enough speed to move swept debris over the top of the brush 221 and into the debris compartment 266. The recirculated air entering housing 222 through opening 228 may assist in movement of the debris over the brush 221 and into the debris compartment 234. The fan 256 has sufficient air capacity for drawing air into the housing 222 and into the debris compartment 234. This provides for dust control. It is desired that the volume of air discharged through the fan 256 be kept as low as possible and still maintain effective dust control. The air recirculated by fan 257 provides a substantial air current through compartment 234 thereby moving lightweight debris to the rear of compartment 234. It has been found that if fan 256 is operated and fan 257 not operated, lightweight debris tends to collect in the forward part of the debris compartment 234 and builds up sufficiently to block the opening 242 before the debris compartment 234 is filled. However, when 257 is operating, the return air, discharged through opening 266, moves through the brush housing 222, through opening 242 and moves lightweight debris toward the back of compartment 234. As a result, material is kept from clogging in the brush chamber and accumulates first at the end of the hopper remote from the bursh. In a manner similar to 110, sweeper 210 alternatively may use a single fan.

Figure 5:
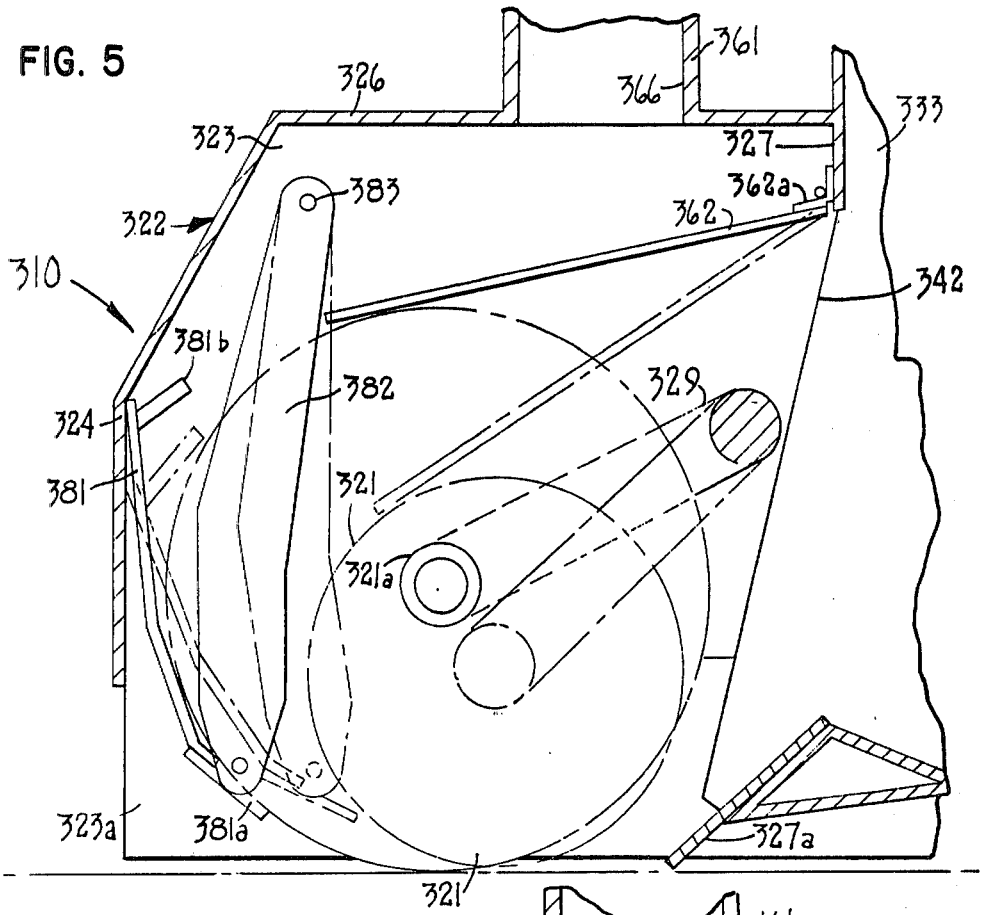
FIG. 5 is an enlarged fragmentary view of a brush housing.

FIG. 5 shows another embodiment 310 of the present invention. The overall construction of sweeper 310 may be similar to sweeper 10. The sweeper 310 has a downwardly opening brush housing 322 including a top wall 326, vertical side walls 323, a rear wall 324 and a front wall 327. Flexible skirts 323*a*, for example, made of heavy rubber, are dependingly mounted on the lower edge portions of the side walls 323. The lower edge of the front wall 327 together with the predominantly vertical front edges of the side walls 323 define a discharge opening 342 directly into the hopper 333.

Sweeper 210 has a cylindrical rotary brush 321 including a brush core 321*a*. Brush 321 is rotatably carried by a pair of radial arms 329. A first end of each arm 329 is secured to brush core 321*a* and the opposite end of each radial arm is povotally connected to the sweeper frame 311.

A conventional drive mechanism is provided between the brush 321 and the power source (not shown) of the sweeper 310. A flap 362 is hinged at 362*a* to front wall 327. The flap 362 has a length sufficient to permit flap 362 to bear against the upper portion of brush 321 in a tangential manner. The hinged flap 362 rides against the upper portion of the brush regardless of whether the brush be a large diameter brush such as illustrated in solid outlines in FIG. 6, or a small diameter (e.g. worn) brush such as indicated in broken lines in FIG. 5. Further, the flap 362 is of sufficient width to extend to a point closely adjacent side walls 323. Flap 362 is freely movable relative to side walls 323. The axis of hinge 362*a* preferably is located at a higher elevation than the upper portion of the largest diameter brush 321 to be used. Thus the flap 362 is always inclined upwardly toward the inlet 342. A port 366 is provided in the upper wall 326 of brush housing 322 above flap 362. The flap 362 serves to direct the air flow in the upper part of the housing and to reduce or eliminate the passage of swept material over the top of the brush 321.

The brush housing 322 has an air deflector 381 pivotally supported by a pair of arms 382. The deflector 381 prevents leakage of air even after the brush 321 has become worn. The brush supporting radial arms 329 extend forwardly and upwardly. Thus, as the brush 321 wears, its point of contact with the floor moves progressively horizontally forwardly of the lower portion of rear wall 324 and the rear portion of the brush 321 moves further away from the rear wall 324. The deflector 381 is provided to eliminate or minimize leakage of air between the brush 321 and the rear wall 324 as the brush wears. The deflector 381 extends from adjacent one housing side wall 323 to a point adjacent the other. Only a small clearance space is provided between deflector 381 and brush 321.

The upper ends of the arms 382 are connected by pins 383 to the side walls 323 of the housing 322 for pivotal movement about an axis parallel to the axis of rotation of the brush. The lower ends of arms 382 are connected to portion 381*a* of deflector 381 by pins 384. The pins 383 are located higher than pins 384 and higher than the top of the maximum diameter brush 321 utilized in the housing 322. The pivot pins 383 are located rearwardly of the center axis of the brush 321, such that the center of gravity of the rear deflector 381 is located far enough behind arms 382 to urge the lower portion of front lip 381*a* against the brush 321 for positive contact with brush 321. The lower portion 381*a* is spaced a small distance, for example 1" or 1½", above the floor or surface being cleaned, while the remainder of the deflector extends predominantly upwardly and rearwardly. The upper edge portion of deflector 381 freely bears against the housing rear wall 324 at a position above the center axis of the brush 321. Deflector 381 has rods 381*b* attached to its upper and outer corners. The rods 381*b* extend upwardly and outwardly. The rods 381*b* are aligned with arms 382 and prevent the upper portion of the deflector 381 from pivoting about members 384 to a position where the upper portion of deflector 381 bears against the brush 321. In other words, the rods 381 contact arms 382 if the upper portion of deflector 381 is moved away from wall 324. Arms 382 are slightly angled so that even when the deflector lip 381*a* is against the smallest brush periphery, the center of mass of the deflector is behind the pivot axis of pins 384. This causes the deflector to pivot on pins 384 to a position where the deflector upper portion bears against the rear wall 324.

The operation of sweeper 310 is generally similar to that described with regard to sweeper 10. The brush is rotatably driven in a counter-clockwise direction as shown in FIG. 5 such that material is projected by a lower portion of the brush 321 into the compartment 333, rather than over the top of the brush as with the sweeper 210. With embodiment 310 of FIG. 5, a substantial portion of the air discharged through port 366 flows along the upper portion of flap 362. Since the lower portion 381*a* of deflector 381 bears against the brush 321, most of the recirculating air moves through the brush 321 and thence across the housing carrying material raised by the brush into the hopper 333. The recirculating air provides more uniform distribution of lightweight debris and more densely packed debris across the full length of the hopper 333 than if the recirculating air were not provided. The flap 362 serves to block the movement of most material over the top of the brush. Any material that is carried over the top of brush 321 is directed by the deflector 381 to pass beneath the brush where it will be acted upon again by the brush and delivered to the debris hopper 333. Thus, the flap 362 and deflector 381 serve to reduce trailing debris. The flap 362 and deflector 381 further provide improved hopper loading characteristics by providing smoother air flow patterns with litter being carried into the hopper 333 and densely packed. This provides a maximum filling of the hopper 333.

Due to the mounting structure of the flap 362, the flap pivots as the brush wears, so that the flap 362 is maintained in contact with the upper part of the brush 321. The lower portion 381*a* of the deflector 381 also moves to retain contact with the brush 321 as wear takes place. As the brush 321 wears, deflector 381 pivots forwardly as shown in broken lines to maintain the deflector 381 in abutting relationship with the brush 321.

Figure 6:
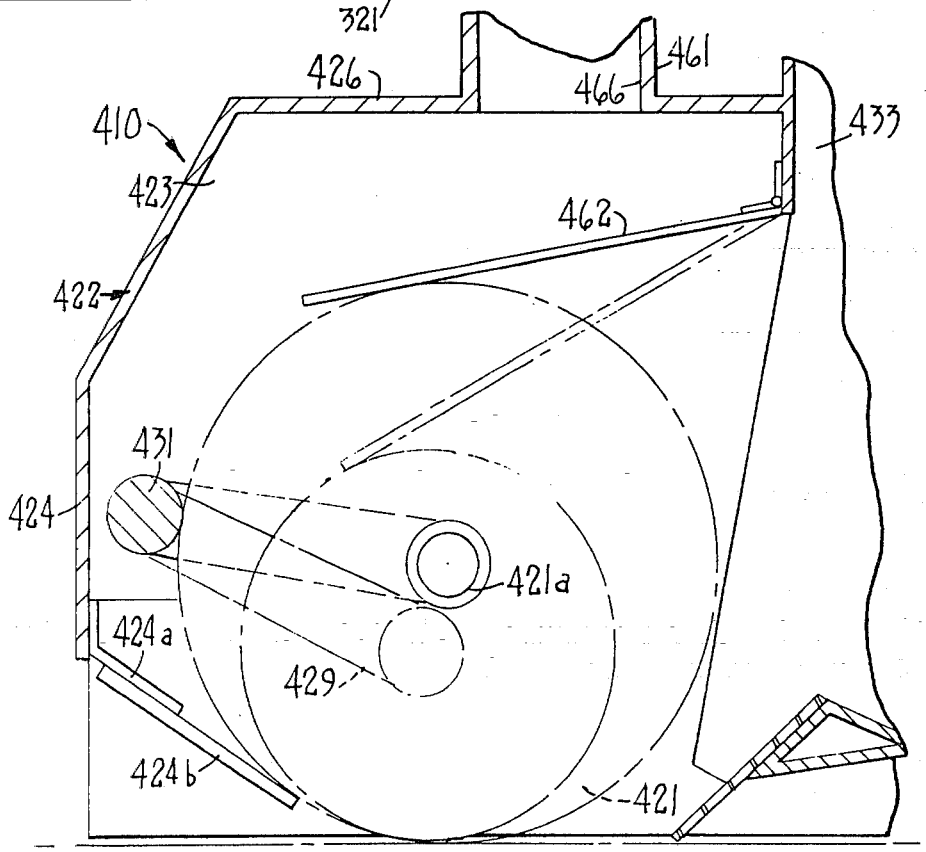
FIG. 6 is a fragmentary side elevational view of the brush housing portion of an additional embodiment of the present invention.

A further embodiment according to the present invention is shown in FIG. 6. Sweeper 410 is constructed substantially identically to sweeper 310. In sweeper 410 the brush housing structure 422 has been modified. Sweeper 410 has a brush housing 422. Radial arms 429 are pivotally connected to the housing 422 by pins 431 while the forward ends of the radial arms 429 support brush 421 for rotation. The core 421*a* of brush 421 is located forward of the pins 431. A flap 462 is mounted to bear against the brush 421 in the manner described with reference to sweeper 321.

The lower portion of the rear wall 424 of housing 422 has a bracket 424*a* that extends thereacross. The bracket 424*a* is for mounting a deflector 424*b* that extends from one side wall 423 to the other side wall of the housing 422. The deflector 424*b* declines in a forward direction. The length and mounting of the radial arms 429 and the declining angle of the deflector 424*b* are such that the deflector 424*b* will be closely adjacent or in abutting engagment with the brush 421 along a line that is approximately tangential to various sizes of brushes. That is, the deflector 424*b* will lie tangential both to the large diameter brush 421, as well as the smaller diameter brush shown in broken lines in FIG. 6. Recirculating air is transferred from the hopper 433 to the housing 422 in the same manner as described with reference to sweeper 10.

The operation of this embodiment of the invention is substantially identical to that described with reference to sweeper 310, except that as the brush wears, the radial arms 429 pivot in the direction of the deflector 424*b* whereby the brush 421 remains closely adjacent the delfector 424*b* instead of the deflector moving as described with reference to sweeper 310.

Figure 7:
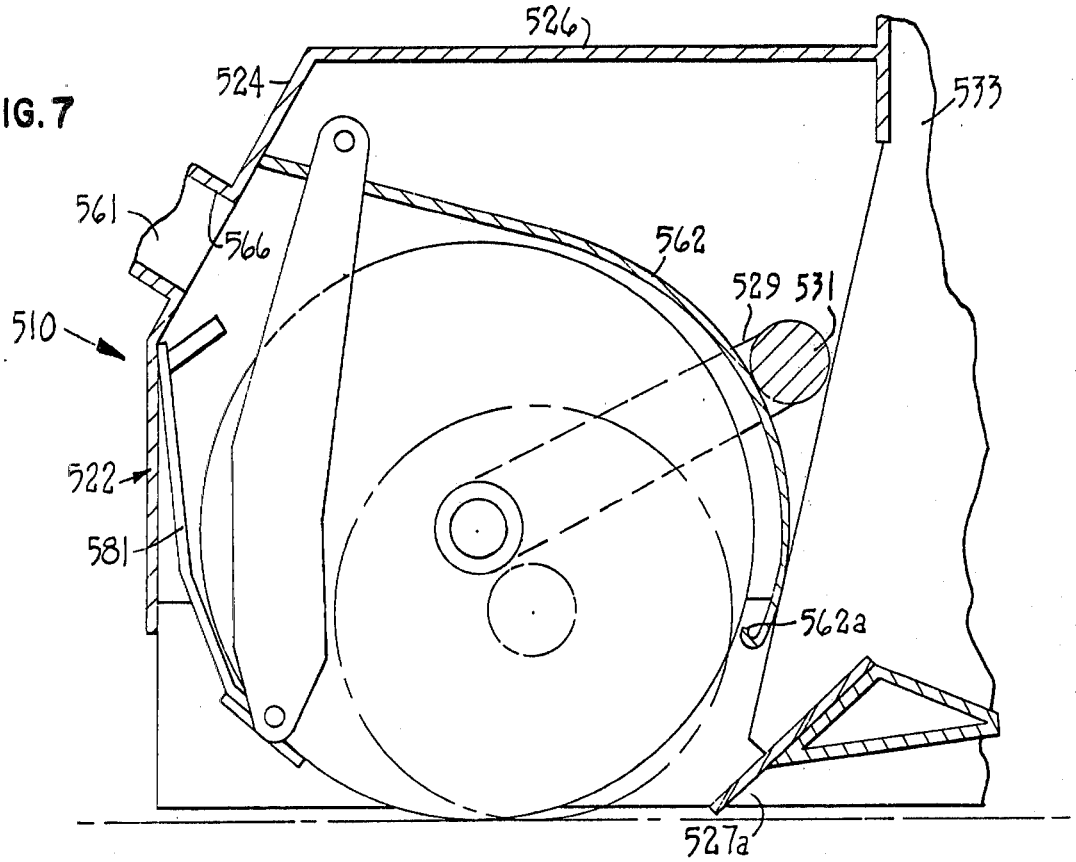
FIG. 7 is a fragmentary side elevational view of the brush housing portion of a further embodiment of the present invention in which a flap or baffle is fixedly mounted in the brush housing.

A further embodiment of the invention, sweeper 510 is shown in FIG. 7 and includes a brush housing 522, a hopper 533 and a deflector 581 that are of the same construction as shown with respect to sweeper 310. The top wall 526 of the housing 522, however, has no recirculating air inlet port. Instead, a conduit 561 feeds recirculating air from a fan (not shown) to an inlet port 566 in rear wall 524. Further, in place of the hingedly mounted flap of the second embodiment, the sweeper 510 includes a baffle or flap 562 that is mounted in a fixed position in the housing 522. The rear portion of flap 562 is fixedly attached to the housing rear wall 524 above port 566. The flap 562 extends forwardly from the rear wall 524 and has an arcuately-shaped portion which extends closely adjacent the top peripheral part of the brush. The fixed flap 562 extends forwardly of the brush and downwardly terminating in a curved flange portion 562*a*. The flange portion 562*a* in a normal sweeping position of the housing is spaced from the surface being cleaned by a distance that is desirably approximately equal to or slightly less than the radius of the smallest diameter (i.e. worn) brush to be used and is substantially spaced from the lip 527*a*. Thus, with the brush being mounted on forwardly extending arms 529, as the brush wears and the arms 529 pivot on pin 531 the portion 562*a* increases only slightly. The flange portion 562*a* minimizes or eliminates swept material being moved up over the top of the brush 521. Further, the flap 562 acts in cooperation with the brush 521 for directing at least the major portion of the recirculating air between the brush 521 and deflector 581, thence generally across the housing, through the open zone between flange portion 562*a* and the lip 527*a*, and into the hopper 533. Preferably the flap 562 extends from one housing side wall to the opposite side wall with cutouts being provided through which arms 529 may extend.

Figure 8:
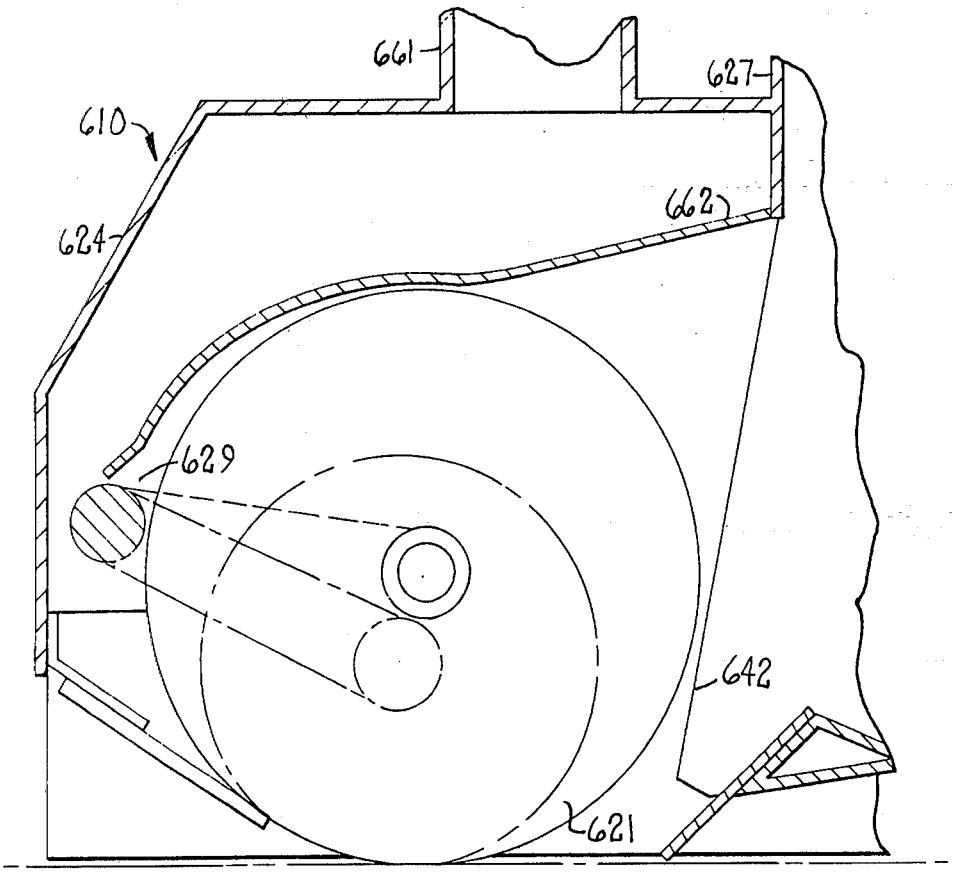
FIG. 8 is a fragmentary side elevational view of the brush housing portion of another embodiment of the invention which has a fixedly mounted flap.

Another embodiment of the invention, sweeper 610 (FIG. 8), is of substantially the same construction as sweeper 410. However, the hinged flap is replaced with a fixedly mounted baffle or flap 662 that extends between the side walls of the brush housing. The flap 662 has its front edge fixedly attached to the lower part of wall 627. Flap 662 extends rearwardly with a longitudinally intermediate portion closely adjacent and above the top peripheral part of the brush 621. The flap 662 is thence curved downwardly and rearwardly with its rear terminal edge closely adjacent the arm pivot 629. The terminal edge of flap 662 is substantially spaced from the housing rear wall 624. Recirculating air is fed into the housing 622 through conduit 661 and flows downwardly between the rear edge of flap 662 and the housing rear wall 624. The brush 621 is rotated in a counter-clockwise direction as shown in FIG. 8. At least the majority of the recirculating air moves forwardly through the brush (i.e. between the brush core and the surface being cleaned) and passes into the hopper inlet 642. The fixed flap 662 aids in keeping down the amount of swept material passing over the top of the brush, particularly when larger diameter brushes are used. Flap 662 also provides air flow patterns which facilitate complete filling of the hopper.

Figure 10:
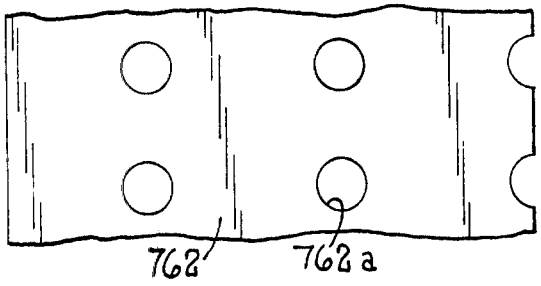
FIG. 10 is a portion of the brush housing of FIG. 9 taken along the line 10—10.
Figure 9:
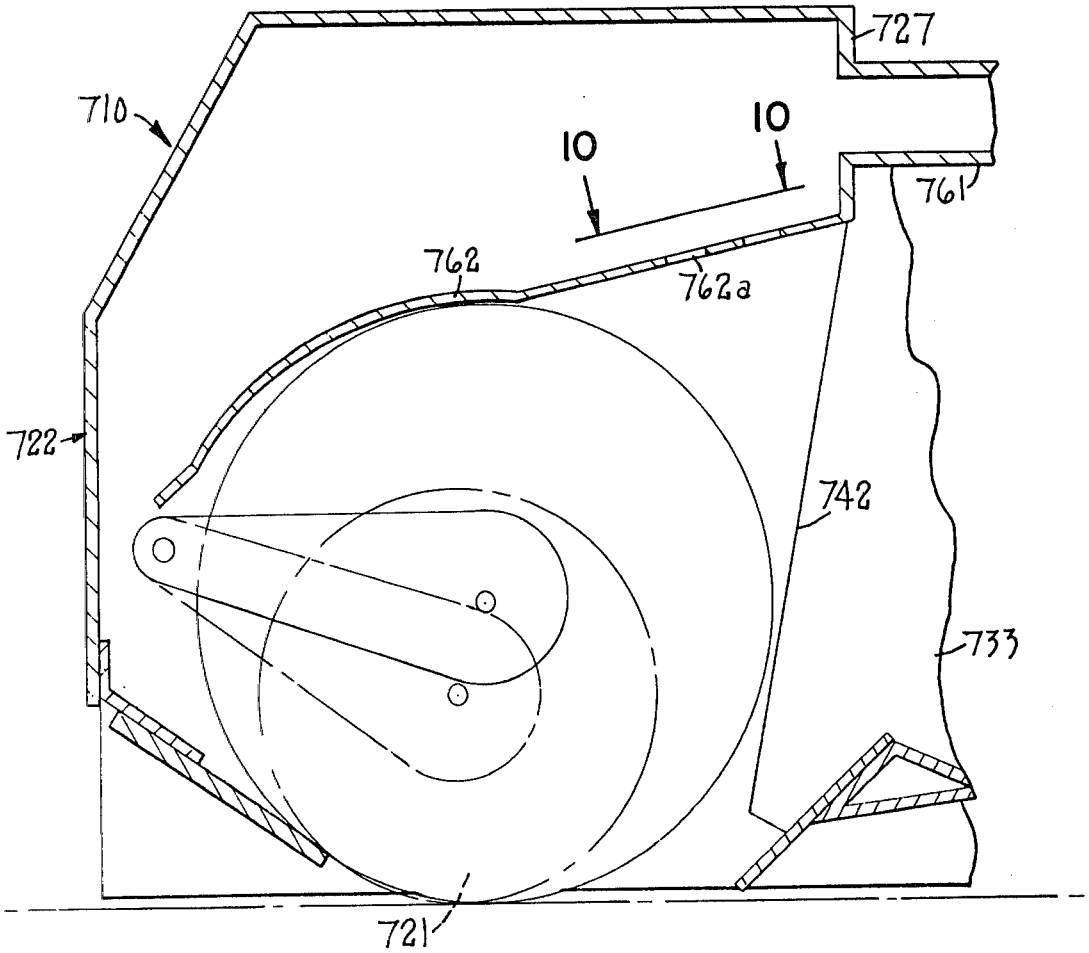
FIG. 9 is a fragmentary side elevational view of another brush housing portion.

A further embodiment 710 of the present invention is shown in FIGS. 9 and 10. Sweeper 710 may be very similar to sweeper 610, however, the recirculated air is fed into the brush housing 722 by duct 761 which is associated with housing front wall 727. The flap 762 is provided with a plurality of openings 762*a* thus permitting a portion of the recirculated air to go directly to the opening 742 into hopper 733. The remainder of the recirculated air passes over flap 762 and then back through brush 721. The concept of air openings as demonstrated with 762 may be used on any of the other flaps such as 362,462 and 562.

With reference to each of the embodiments of the invention, a suitable door (not shown) may be provided that opens to the debris compartment of the hopper for removal of debris. A second door is provided that opens to the filter compartment of the hopper for cleaning or replacing the filter. Alternately, the hopper may be mounted on a sweeping machine for movement relative thereto between the operating position shown in the drawings and an elevated dumping position (not shown). If the hopper is mounted for dumping movement, the conduits would be preferably of a flap construction, or could be separated from the hopper during dumping and resealed upon lowering the hopper in a manner similar to that shown in U.S. Pat. No. 3,304,572. With reference to each of the sweepers 310, 410 and 510, the hopper may be of construction and mounted in a manner that is disclosed in U.S. Pat. No. 3,304,572; however, the present invention includes the recirculating air and the provision of a vacuum blower mounted and connected to the hooper in a manner that has been disclosed in this application.

The present recirculating air fan may be of a type that is a high-volume, low-pressure fan. By using such a recirculating air fan, when sweeping lightweight litter, a greater volume of lightweight litter can be loaded into a hopper and thus obtain a saving in power requirements from that of conventional machines which filter all the air passing through the sweeper.

In each of the embodiments the screen serves to provide a low velocity air interface between the hopper and the filter where litter would be stopped without packing to such density that air could not pass through it. The screen serves to separate bulky material that may tend to get airborne and lodge in the filter. The screen allows the bulky material to drop back into the debris compartment.

In each of the sweepers 310, 410, 510 and 610 (even with the provision of the flap in the brush housing), the recirculating air aids in proper filling of the hopper and aids in reducing trailings. In the sweepers 310 and 510, the brush on wearing pivots toward the hopper to maintain a nearly constant relationship between the brush periphery and the sweeping lip. The brush pivot arm together with the brush itself functions to aid in directing airflow in a forward direction, thus facilitating filling the hopper. Moreover, the rear deflector can move with respect to the arms and alter the space behind the brush to allow, for example, a metal can or a piece of 2×4 to either be directed under the brush to be reswept, or pass under the deflector and escape. Sufficient flow of air through the filter should be provided to maintain dust control. Sufficient recirculation of air should be provided to carry litter to the end of the hopper remote from the brush. The air flow required will of course vary depending upon the size of the sweeping machine.

What is claimed is:

1. A surface cleaning machine having a normally longitudinally forward direction of movement, said machine comprising a frame, a plurality of surface engaging wheels suitable for supporting said frame, a debris pickup housing supported by the frame, said housing having a downwardly facing opening and a debris discharge opening, means for sweeping material from beneath said housing through the debris discharge opening, a hopper supported by the frame, said hopper having a debris inlet opening directly communicating with the housing discharge opening, said hopper having a portion remote from the debris inlet opening, a single blower for withdrawing air from said hopper remote portion and a filter chamber associated with said hopper, said single blower moving one portion of the air through said filter chamber and from thence to the ambient atmosphere and simultaneously moving a second portion of air into the hopper, thereby recirculating said second portion of air under pressure whereby at least a substantial quantity of said air moves again through said hopper to assist in propelling light weight debris in a direction toward said remote hopper portion thereby facilitating picking up debris and filling of said hopper with debris.

2. The surface cleaning machine of claim 1 wherein said machine includes diverter means for separating the air flow into a recirculation air flow and a filter air flow.

3. The surface cleaning machine of claim 1 wherein the direction of rotation of said brush is such as to sweep debris directly through said debris discharge opening.

4. A surface cleaning machine having a normally longitudinally forward direction of movement, said machine comprising a frame, a plurality of surface engaging wheels supporting said frame, a brush housing supported on the frame, said brush housing having a downwardly facing opening and a debris discharge opening, a power driven brush mounted in the housing for rotation about a transverse axis, said brush being adapted to engage the surface to be cleaned while directing swept material toward the debris discharge opening, a hopper supported on the frame, said hopper having a debris inlet opening communicating with the brush housing discharge opening, said hopper having an upper portion remote from the debris inlet opening, air recirculating means comprising a single blower for withdrawing air from said hopper upper portion and discharging a first portion of said air to the atmosphere and a second portion of said air under pressure into the brush housing, whereby at least a substantial quantity of said air moves again through the housing, debris discharge opening and hopper to assist in propelling light weight debris in a direction toward said hopper upper portion thereby facilitating filling of said hopper with debris.

5. The apparatus of claim 4 wherein the hopper has a divider wall for separating the hopper into a filter compartment and the debris compartment, said divider wall having a port opening therethrough that places the filter compartment in fluid communication with the debris compartment at a location remote from the hopper debris inlet.

6. The apparatus of claim 5 further including a screen extending across the debris compartment and spaced from the divider wall to provide an air flow space therebetween, said screen serving to block bulky material being carried by the airstream to the divider wall port, said divider wall port and air recirculating means inlet opening being on the opposite side of the screen from the hopper debris inlet.

7. The apparatus of claim 4 wherein the brush is rotatably mounted on pivotable arms, said arms having first end portions remote from the brush, and means for mounting said first end portions to said housing for transverse pivotal movement.

8. A surface cleaning machine comprising a frame, surface engaging wheels mounted on the frame, a brush housing mounted on the frame, said brush housing having a brush opening that opens downwardly and a debris discharge opening, a power driven brush mounted in the housing for rotation about a transverse axis, said brush being adapted to engage the surface to be cleaned and to direct swept material through the debris discharge opening, a hopper mounted on the frame, said hopper having a debris inlet opening in direct communication with the housing discharge opening, said hopper having an upper portion remote from the debris inlet opening, air recirculating means including a single blower for withdrawing air from said hopper upper portion and discharging air under low pressure through the housing and through the debris discharge opening, said hopper having a debris receiving portion and filter means for separating debris particles from an airstream, said single blower including means for discharging a first filtered portion of air to the ambient atmosphere and recirculating a second unfiltered portion of said air.

9. A surface cleaning machine having a normally longitudinally forward direction of movement, said machine comprising a frame, a plurality of surface engaging wheels suitable for supporting said frame, a debris pickup housing transported by the frame, said debris pickup housing having a downwardly facing opening and a debris discharge opening, means adapted to engage the surface to be cleaned and direct swept material through the debris discharge opening, a hopper supported with respect to the frame, said hopper having a debris inlet opening adjacent one end thereof, said inlet opening communicating directly with the debris pickup housing discharge opening, said hopper having an air outlet opening associated with the end opposite said one end, said air outlet opening being remote from the debris inlet opening, air recirculating means comprising a single blower for withdrawing air from said hopper through said air outlet opening and discharging a first portion of said air under pressure into the debris pickup housing whereby at least a substantial quantity thereof moves through the housing and again through said hopper to assist in propelling light weight debris in a direction toward said opposite end in said hopper thereby increasing the effective capacity of said hopper, said single blower including means for discharging a second portion of said air through a filter and into the atmosphere.

10. The surface cleaning machine of claim 9 wherein said means for engaging said surface is a power driven cylindrical brush mounted in the housing for rotation about a transverse axis and wherein the direction of rotation of said brush is such as to sweep debris directly through said debris discharge opening.

* * * * *